US005621924A

United States Patent [19]

Friedman et al.

[11] Patent Number: 5,621,924

[45] Date of Patent: Apr. 22, 1997

[54] VACUUM TANK CONSTRUCTION FOR A VACUUM TOILET ASSEMBLY

[75] Inventors: William J. Friedman, Big Prairie; James A. Sigler, Perrysville, both of Ohio

[73] Assignee: Sealand Ttechnology, Inc., Big Prairie, Ohio

[21] Appl. No.: 484,843

[22] Filed: Jun. 7, 1995

[51] Int. Cl.[6] ..... E03D 11/00

[52] U.S. Cl. ..... 4/431; 4/433; 4/321; 4/434; 4/323

[58] Field of Search ..... 4/431, 432, 433, 4/434, 321, 322, 323, 319

[56] References Cited

U.S. PATENT DOCUMENTS

| | | | |
|---|---|---|---|
| 3,732,579 | 5/1973 | Allander et al. | 4/431 |
| 4,159,550 | 7/1979 | Tobin, Jr. | 4/431 |
| 4,783,859 | 11/1988 | Rozenblatt et al. | 4/321 |
| 5,345,618 | 9/1994 | Sigler et al. | 4/432 |
| 5,408,704 | 4/1995 | Bailey et al. | 4/431 |

*Primary Examiner*—Henry J. Recla

*Assistant Examiner*—Kam R. Shah

*Attorney, Agent, or Firm*—Nixon & Vanderhye P.C.

[57] ABSTRACT

A particular vacuum tank construction is provided for a vacuum toilet assembly which mounts a vacuum pump, has great versatility and accessibility, and ensures optimized washing effect of water and waste into the vacuum tank. A tank inlet is located at the opposite end of the tank from a sump formed in the tank bottom, and an inlet fitting at the inlet is rotatable at least about 180° about a vertical axis. Connected to a tank outlet is a dip tube assembly including a substantially rigid dip tube which has an oval shaped end termination opening which is above, but spaced from, the sump and positioned so that objects of a size that would harm the vacuum pump connected to the tank outlet cannot enter the dip tube. The tank is of plastic having a nominal wall thickness of about 5/16th inch, and no flat surface area is greater than about 80 square inches. The inlet is connected to a vacuum toilet, and the vacuum pump outlet is connected to a waste (holding) tank. The vacuum pump is mounted on a first top surface of a vacuum pump and is readily connected or disconnected to and from the dip tube by a spin nut. The tank includes a hollow vertical portion having an inner sidewall in which the tank outlet opening is formed, and to which a vacuum switch is connected.

21 Claims, 5 Drawing Sheets

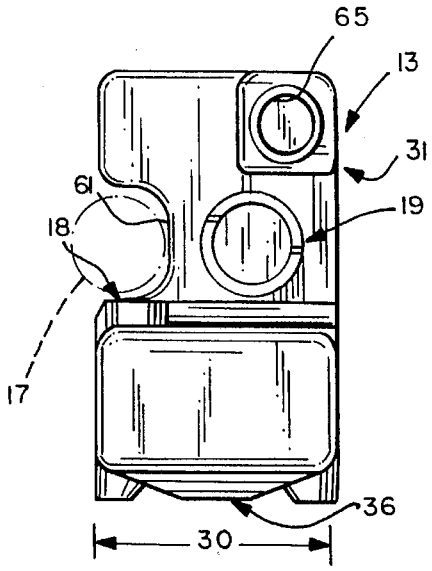
Fig. 3
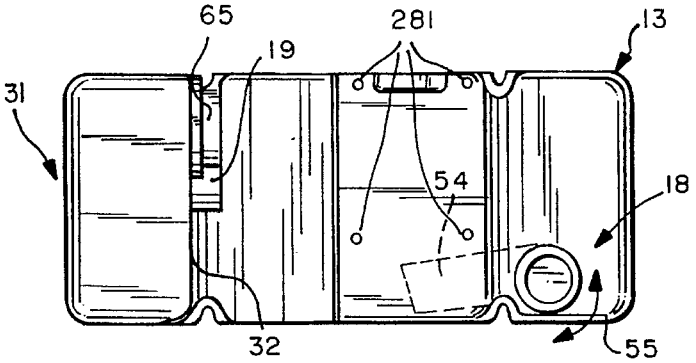
Fig. 4
Fig. 5
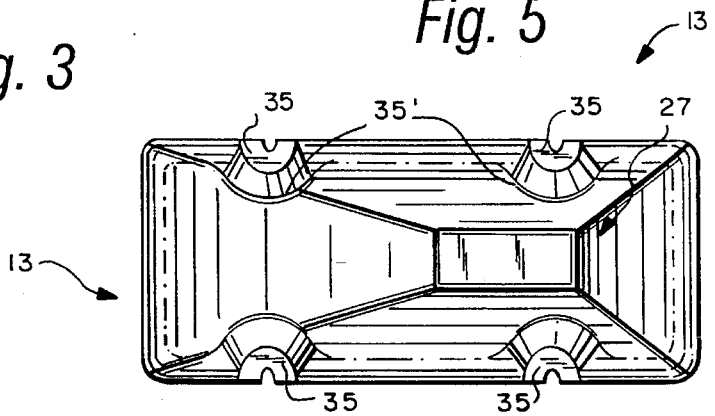
Fig. 6
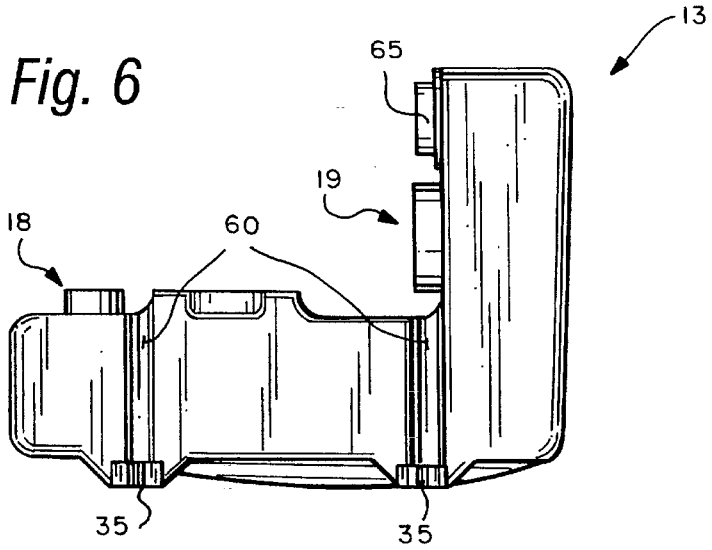

VACUUM TANK CONSTRUCTION FOR A VACUUM TOILET ASSEMBLY

BACKGROUND AND SUMMARY OF THE INVENTION

In U.S. Pat. No. 5,408,704 (the disclosure of which is hereby incorporated by reference herein) a low volume vacuum toilet assembly is provided which can fit in vehicles and boats where vacuum toilets were previously impractical, while also providing minimum water usage. While the assembly shown therein is eminently practical and desirable, there are a few aspects of the vacuum tank construction and relationship with the vacuum pump that are less than optimum for some circumstances.

According to the present invention a vacuum tank, particularly for use in association with a vacuum toilet assembly, is provided which retains the low volume characteristics of the structures disclosed in U.S. Pat. No. 5,408,704 while having other advantages associated therewith that make the vacuum tank, and vacuum tank and pump assembly, more versatile and effective.

According to the present invention, the vacuum tank is constructed, and positioned with respect to the vacuum pump, so that there is an optimized washing effect of water and waste into the vacuum tank. The inlet is located at the opposite end of the tank from a sump area that is formed in the tank bottom, so that the entering waste washes down to the sump carrying all materials with it. This washing effect keeps the tank from building up deposits of tissue which would reduce the vacuum capacity and performance efficiency. Also, a substantially rigid dip tube is provided in the tank having a generally oval-shaped bottom portion thereof mounted just above the sump and positioned in such a way that objects of a size that would damage the pump cannot pass into the dip tube, while still effectively allowing the free passage of liquid and waste into it.

The vacuum pump is mounted on a top surface of the vacuum tank, and is—as in said U.S. Pat. No. 5,408,704—directly connected to the vacuum tank outlet. The tank includes a generally vertically extending portion which has an inner sidewall in which the outlet opening is formed, and from which the dip tube extends. The dip tube and pump are mounted so that they may be readily detached from each other using a spin nut, and the dip tube itself can be readily removed since it has a plug connection to the outlet opening which is sealed by a pair of O-rings.

The vacuum tank inlet has a fitting associated with it which also is readily replaceable, having a double O-ring construction, and in the form of an elbow. The elbow fitting may be rotated at least about 180° with respect to the tank so as to provide great versatility in positioning of the elements and connection up to the vacuum toilet, and a recessed area is provided in the tank vertically extending portion to allow the inlet hose to extend through it so as to provide ready attachment to the rotatable elbow fitting.

The tank is of plastic and has a nominal wall thickness of 5/16th inch. All flat surface areas are limited to under about 80 square inches in area so that there will not be significant deflection, and to provide the lightest tank possible with high structural integrity. The tank may be made of polyethylene or polypropylene, or any other suitable plastic, with such a construction not being limited to any particular plastic.

According to one aspect of the present invention a vacuum toilet assembly is provided comprising the following elements: A vacuum toilet having a waste discharge normally closed by a vacuum-tight valve. An actuator for the vacuum-tight valve. A vacuum tank having a first top surface, a bottom, a length, a width, an inlet, and an outlet. A waste tank having an inlet and an outlet. A vacuum pump having an inlet and an outlet. A first hose connecting the waste discharge of the toilet, adjacent the vacuum-tight valve, to the vacuum tank inlet. A second hose connecting the vacuum pump outlet to the waste tank inlet. The vacuum tank outlet directly connected to the vacuum pump inlet. And, the vacuum pump mounted on the first top surface of the vacuum tank.

The vacuum tank inlet is on the opposite side of the vacuum tank outlet along the length of the tank, and also along the width of the tank. The pump is mounted on the vacuum tank between the vacuum tank inlet and outlet along the length of the tank. The vacuum tank preferably further includes a vertically extending end portion, extending upwardly from the first top surface, having a second top surface and an inner sidewall facing the vacuum tank inlet, the vacuum tank outlet disposed in the inner sidewall. The vacuum tank inlet is in the first top surface, and a substantially 90° elbow fitting is sealingly rotatably mounted in the vacuum tank inlet (having an arc of rotation of at least about 180°), and connected to the first hose.

A dip tube assembly, including a substantially rigid dip tube which extends from the vacuum tank outlet to just above the vacuum tank bottom, is also provided. The dip tube comprises a substantially circular cross-section plastic pipe which has a portion thereof elongated along an axis of elongation, and having an open end termination remote from the vacuum tank outlet. The end termination is cut at an angle to the axis of rotation so as to define a substantially oval-shaped opening which is above, but spaced from, the vacuum tank bottom, and makes an angle of about 20°–40° (preferably about 30°) with respect thereto. The dip tube typically has a substantially J-shaped configuration and a spin nut connection is provided between the dip tube assembly and the vacuum pump inlet.

The vacuum tank bottom preferably comprises a sump located in substantially the middle of the vacuum tank width, and approximately below the inner sidewall, the end termination opening of the dip tube disposed above the sump and positioned with respect to the sump so that objects of a size that would harm the vacuum pump cannot pass between the vacuum tank bottom and the open end termination into the oval-shaped opening, yet liquid and waste may readily pass therethrough. The dip tube may have an open cross-sectional area of about 3.5–4 square inches (e.g. about 3.8 square inches), with a maximum spacing of the dip tube, at the oval opening, from the sump of about ¾ of an inch. The dip tube assembly also comprises a double O-ring plug, the plug sealingly and readily removably connecting the dip tube assembly to the vacuum tank outlet. The tank typically has four feet extending downwardly from the bottom of the tank and supporting the sump off of a flat substantially horizontal support surface (e.g. in a boat or recreational vehicle). The elbow fitting also comprises a mounting portion having a double O-ring seal which extends substantially vertically and about which the oval fitting is sealingly rotated.

The invention also relates to a vacuum tank comprising: A first top surface, a bottom, a width, a length, an inlet, an outlet, a vertically extending end portion, extending upwardly from the first top surface and having a second top surface and an inner side wall facing the vacuum tank inlet. The vacuum tank outlet in the inner side wall. The vacuum tank inlet in the first top surface. Wherein the vacuum tank inlet is on the opposite side of the vacuum tank from the vacuum tank outlet along the length of the vacuum tank. Wherein the vacuum tank inlet is on the opposite side of the vacuum tank from the vacuum tank outlet along the width of the vacuum tank. And, wherein the vacuum tank bottom comprises a sump located in substantially the middle of the vacuum tank width, and approximately below the inner side wall, remote from the vacuum tank inlet.

Preferably the vacuum tank is of plastic having a nominal wall thickness of about 5/16th inch and flat surface areas, the maximum area of any flat surface area being about 80 square inches, so that there is no significant deflection of the tank walls during generation of the vacuum in the tank. The tank is also typically associated with a vacuum switch which automatically shuts off the vacuum pump at a vacuum of about ten inches of mercury, and turns the pump back on if the vacuum falls to below about eight inches of mercury. The vacuum tank has the preferred dip tube assembly described above mounted in association therewith, and the vacuum pump mounted thereon as also described above.

It is the primary object of the present invention to provide a vacuum toilet assembly, and a vacuum tank for use with a vacuum toilet assembly, that has optimum flexibility in mounting and location, low volume configuration, and optimized washing effect of water and waste therethrough. This and other objects of the invention will become clear from an inspection of the detailed description of the invention and from the appended claims.

BRIEF DESCRIPTION OF THE DRAWINGS

FIG. 3 is a front end view of the vacuum tank of FIGS. 1 and 2;

FIG. 4 is a top plan view of the vacuum tank of FIGS. 1 through 3;

FIG. 5 is a bottom plan view of the vacuum tank of FIGS. 1 through 4;

FIG. 6 is a side elevational view of the vacuum tank of FIGS. 1 through 5;

DETAILED DESCRIPTION OF THE DRAWINGS

Figure 1:
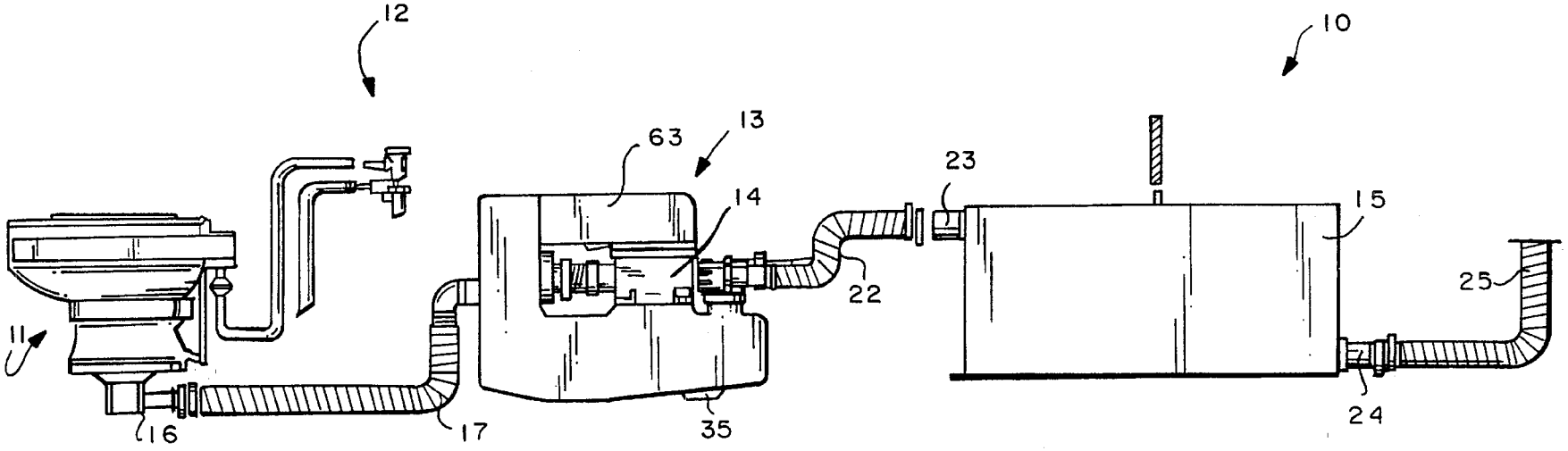
FIG. 1 is a side elevational schematic view of an exemplary vacuum toilet assembly according to the present invention.

FIG. 1 illustrates an exemplary vacuum toilet assembly 10 according to the present invention. The assembly 10 includes a vacuum toilet 11, such as a Vacuflush® Compact Model 106 marketed by Sealand Technology, Inc. of Big Prairie, Ohio, which is supplied water from an appropriate water source such as through the electric valve assembly 12. The assembly 10 also includes a vacuum tank 13 and a vacuum pump 14, and a waste tank (also called a holding tank) 15. The vacuum toilet 11 includes a conventional waste discharge 16 which is normally closed by a vacuum tight valve. The actuator and vacuum tight valve may be as conventional, or such as shown in U.S. Pat. No. 5,408,704.

A first hose 17 is provided for connecting the waste discharge 16 to the inlet 18 to the vacuum tank 13, while the outlet 19 from the vacuum tank 13 is connected to a pump inlet 20. The pump outlet 21 is connected by a second hose 22 to an inlet 23 to the waste tank 15. The outlet 24 from the waste tank 15 may be connected by a hose 25 to a dockside discharge or the like. The waste tank 15 is conventional, having a vent hose associated therewith which may be passed through the hull of a boat if the assembly 10 is mounted in a boat. The assembly 10 takes up a minimum of space and the construction of the vacuum tank 13, and related components, allows great flexibility in mounting and positioning of the assembly 10 in a boat, recreational vehicle, or the like so that space utilization may be optimized.

Figure 2:
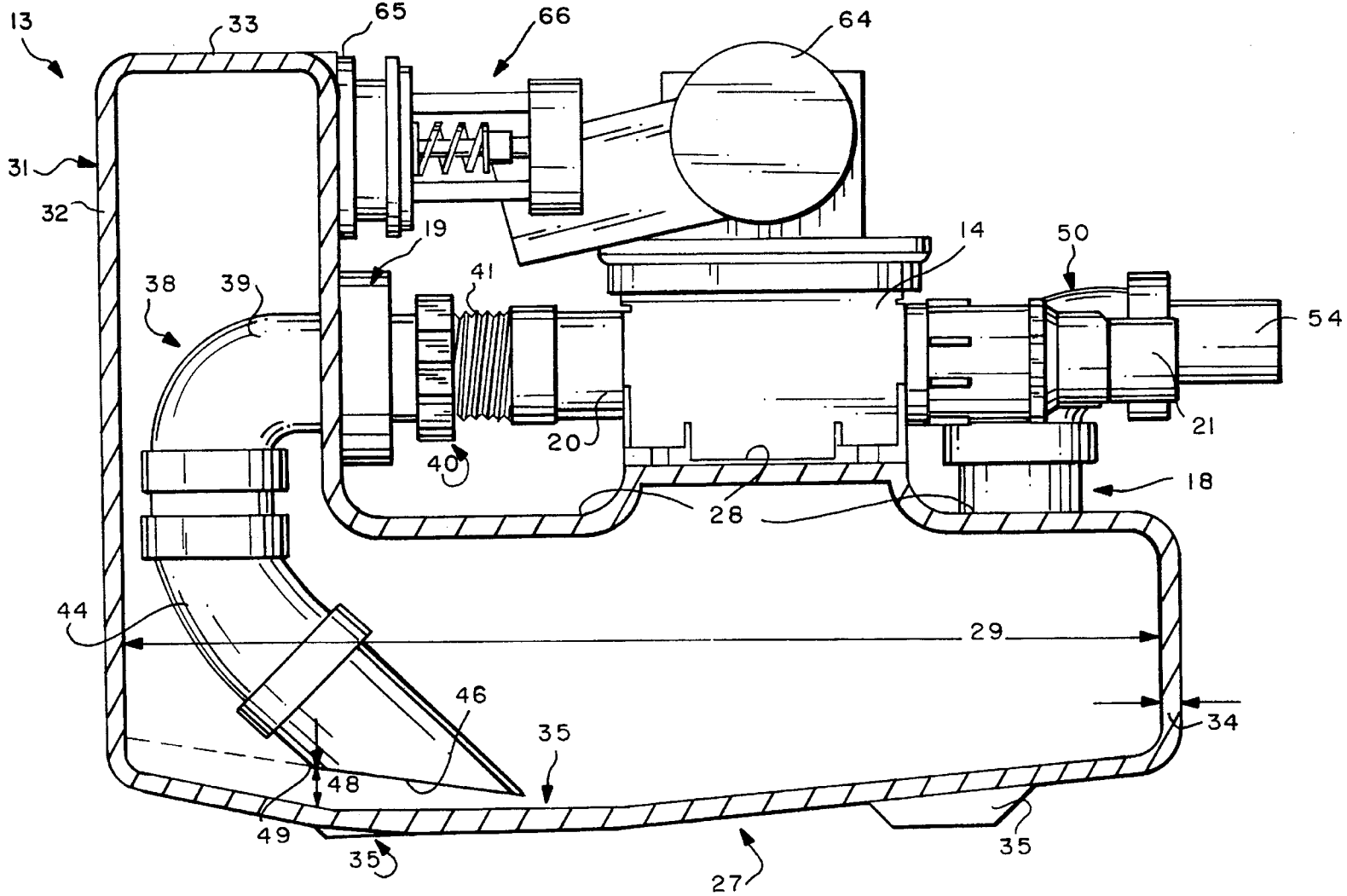
FIG. 2 is a side view, partly in cross-section and partly in elevation, of the vacuum tank and vacuum pump components of the assembly of FIG. 1, in a preferred embodiment thereof.

The construction of the vacuum tank 13 is seen most clearly in FIGS. 2 through 6. The tank 13 has a bottom 27 and a first top surface 28, which top surface 28 may include a raised intermediate portion to which the vacuum pump 14 is connected as illustrated in FIG. 2. The vacuum pump 14 may be connected to the surface 28 by any suitable means, such as four threaded inserts that are molded into the tank and which then engage nuts on the opposite side of mounting flanges for the pump 14, such inserts being shown at 28' in FIG. 4.

The tank 13 also has a length 29 (see FIG. 2) and a width 30 (see FIG. 3). The inlet 18 is preferably provided in the top surface 28 in the position seen most clearly in FIGS. 2 through 4 and 6 and is positioned at a location that is on an opposite portion of the tank 13 from the outlet 19 at least along the length 29, and also preferably along the width 30. The opposite orientations and positions of the openings 18, 19 are most clearly seen in FIGS. 3 and 4.

The tank 13 also includes a vertically extending end portion 31 extending upwardly from the first top surface 28, and having an inner side wall 32 facing the vacuum tank inlet 18, and a second top surface 33. The outlet 19 is preferably provided in the wall 32, as seen most clearly in FIGS. 2 and 3.

The tank 13 is preferably of plastic, and has a substantially uniform wall thickness 34 (see FIG. 2) which is nominally about 5/16th of an inch. The tank 13 may be injection molded, rotational molded, or otherwise constructed, including of a wide variety of plastics including polyethylene and polypropylene. While the tank has a number of flat surface areas since flat surface areas are desirable in order to allow the maximum flexibility in positioning of the vacuum tank 13 in a boat or recreational vehicle for a given volume of the tank 13, no single uninterrupted flat surface area has a surface area of greater than about 80 square inches. In this way one can ensure that there is no significant deflection of the walls of the tank 13 as a result of the vacuum provided within the tank, which vacuum is typically controlled so that it is between about 8–10 inches.

The tank 13 also preferably includes a plurality (preferably four) integrally molded feet 35 which are positioned as seen most clearly in FIGS. 2, 3, 5, and 6. The feet 35 are the lowest portion of the tank 13, supporting the bottom 27 thereof off a substantially flat surface (such as a boat deck or recreational vehicle floor) on which the tank 13 is mounted. Note as illustrated in FIGS. 5 and 6, the feet 35 may have substantially vertical slots formed therein to facilitate sliding the tank 13 in or out of tight compartments, and also the feet 35 are positioned (as seen in FIGS. 3, 5, and 6) so that there is a recess around and above the feet to allow mounting hardware to be driven in from above to hold the feet in place. In particular see the recesses 35' in FIG. 5.

The tank 13 also is constructed so as to have a sump, shown generally by reference numeral 36 and seen most clearly in FIGS. 2, 3, and 5. The sump 36 may, for example, be two inches wide by five inches long and is elevated a small distance (less than an inch) off the supporting surface by the feet 35. The sump 36 is preferably located at approximately the middle of the tank bottom 27 in the width 30 dimension, and in the length 29 dimension approximately below the inner side wall 32, and just to the inlet 18 side thereof. The bottom 27 slopes downwardly, at a substantially regular slope, from all areas to the sump 36.

Figure 7:
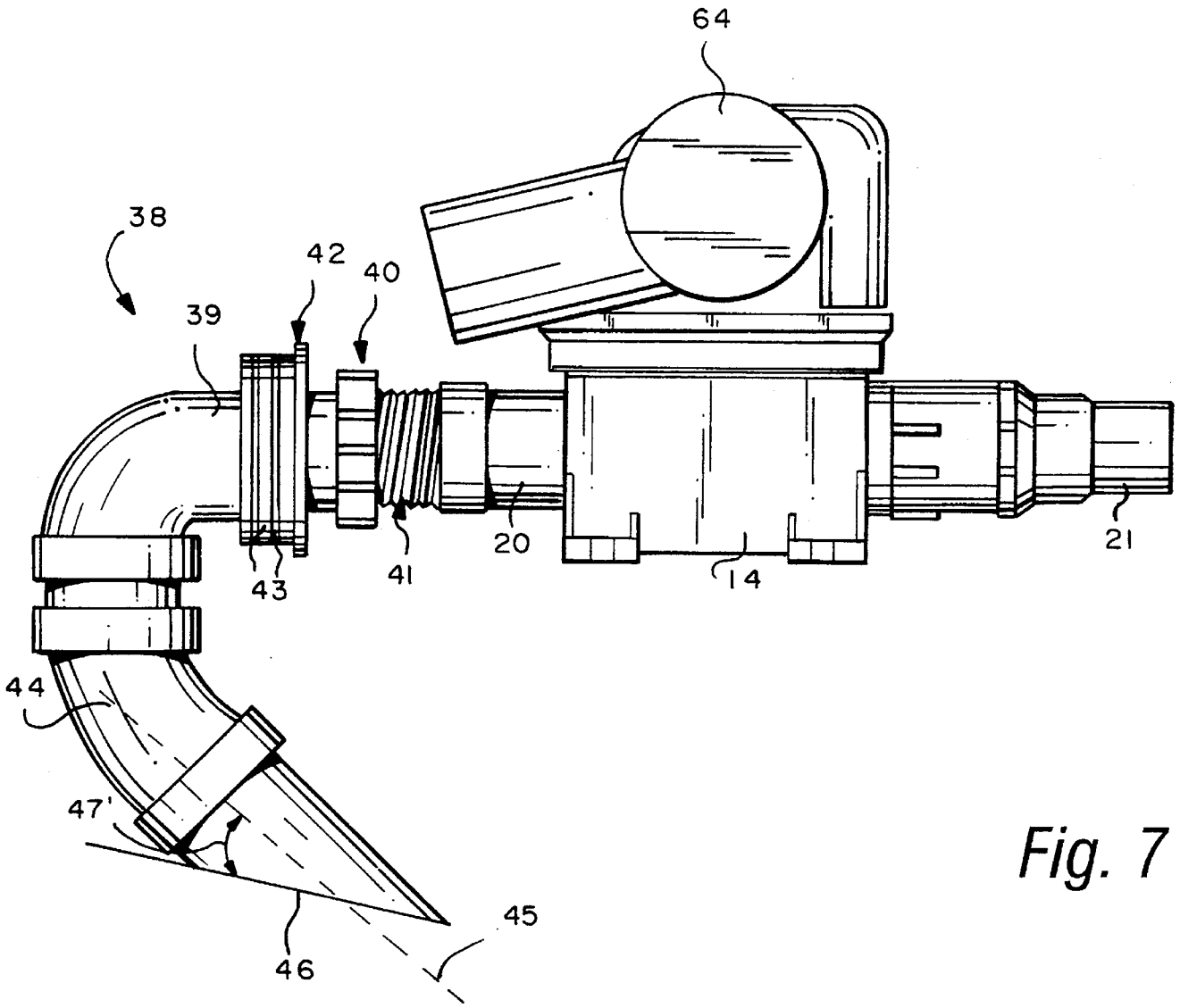
FIG. 7 is a side elevational view of the dip tube assembly and vacuum pump of the apparatus of FIGS. 1 and 2.

The vacuum tank 13 also preferably includes a dip tube assembly, shown generally by reference numeral 38 in FIGS. 2 and 7, associated therewith. The dip tube assembly 38 is configured and mounted so as to optimize the efficient withdrawal of liquid and waste from the tank 13 and to allow ready connection or disconnection from the tank 13 and from the vacuum pump 14.

As seen most clearly in FIGS. 2 and 7, the dip tube assembly 38 comprises a dip tube 39 having a spin nut connection 40 to the externally threaded portion 41 of the vacuum pump inlet 20. The dip tube 39 is connected by a plug 42 (see FIG. 7) within the vacuum tank outlet 19 (see FIG. 2). Sealing engagement is provided by the plug 42 particularly because it has a double O-ring construction 43 (see FIG. 7), the O-rings 43 sealingly engaging the surface defining the outlet 19 in the side wall 32.

The dip tube 39 has substantially a J-shaped configuration, including a tubular portion 44 thereof that is substantially circular in cross-section and is elongated about an axis 45 (see FIG. 7). The tube 44 has an open end termination 46 remote from the vacuum tank outlet 19, the end termination 46 cut at an angle 47 (see FIG. 7) to the axis of elongation 45 so as to define a substantially oval shaped opening at the end termination 46 which is above but spaced from the vacuum tank bottom 27, so that the end termination 46 makes an angle 48 (see FIG. 2) of about 20°–40° (e.g. about 30°) with respect to the bottom 27, and particularly with respect to the sump 36 since the end termination 46 is preferably disposed immediately above and slightly spaced from the sump 36. The maximum spacing 49 (see FIG. 2) between the end termination 46 and the sump 36 is preferably about ¾ of an inch. In one embodiment according to the invention—as seen schematically in FIG. 2—the end termination 46 may vary in spacing from the sump 36 from about 0.125 inches to about 0.875 inches (at the portion 49).

The particular construction and spacing and orientation of the end termination 46 with respect to the sump 36 is such that objects of a size that would harm the pump 14 cannot pass between the bottom 27 and the end termination 46, however liquid and waste may readily pass therethrough. Also the smallest spacing between the end termination 46 and the bottom 27 is at the portion of the tube 44 closest to the inlet. 18, which requires that in-flowing material flow around the end termination 46 rather than directly into the opening therein unless small enough in size (or a liquid) so as to pass between the end termination 46 and the sump 36 closest to the inlet 18.

The oval configuration of the opening at the end termination 46 is similar to the dip tube termination illustrated in FIG. 9 of said U.S. Pat. No. 5,408,704 associated with the waste tank in said patent. The oval opening in end termination 46 may have an area of about 3.5–4 square inches (e.g. about 3.8 square inches). While the tube 39 and the plug 42 may be made of any suitable material, preferably they are of substantially rigid plastic, such as PVC.

The pump 14 construction is preferably conventional, except having a duckbill check valves at the inlet 20 and outlet 21 thereof such as shown in FIGS. 2 and 4 of said U.S. Pat. No. 5,408,704. Also according to the present invention it is desirable to provide such check valves (not shown in FIGS. 2 or 7) so that there are two at both the inlet 20 and outlet 21. This additional, fourth, valve compared to the construction in said U.S. Pat. No. 5,408,704, reduces the potential for pump failure due to a valve being blocked.

Figure 8:
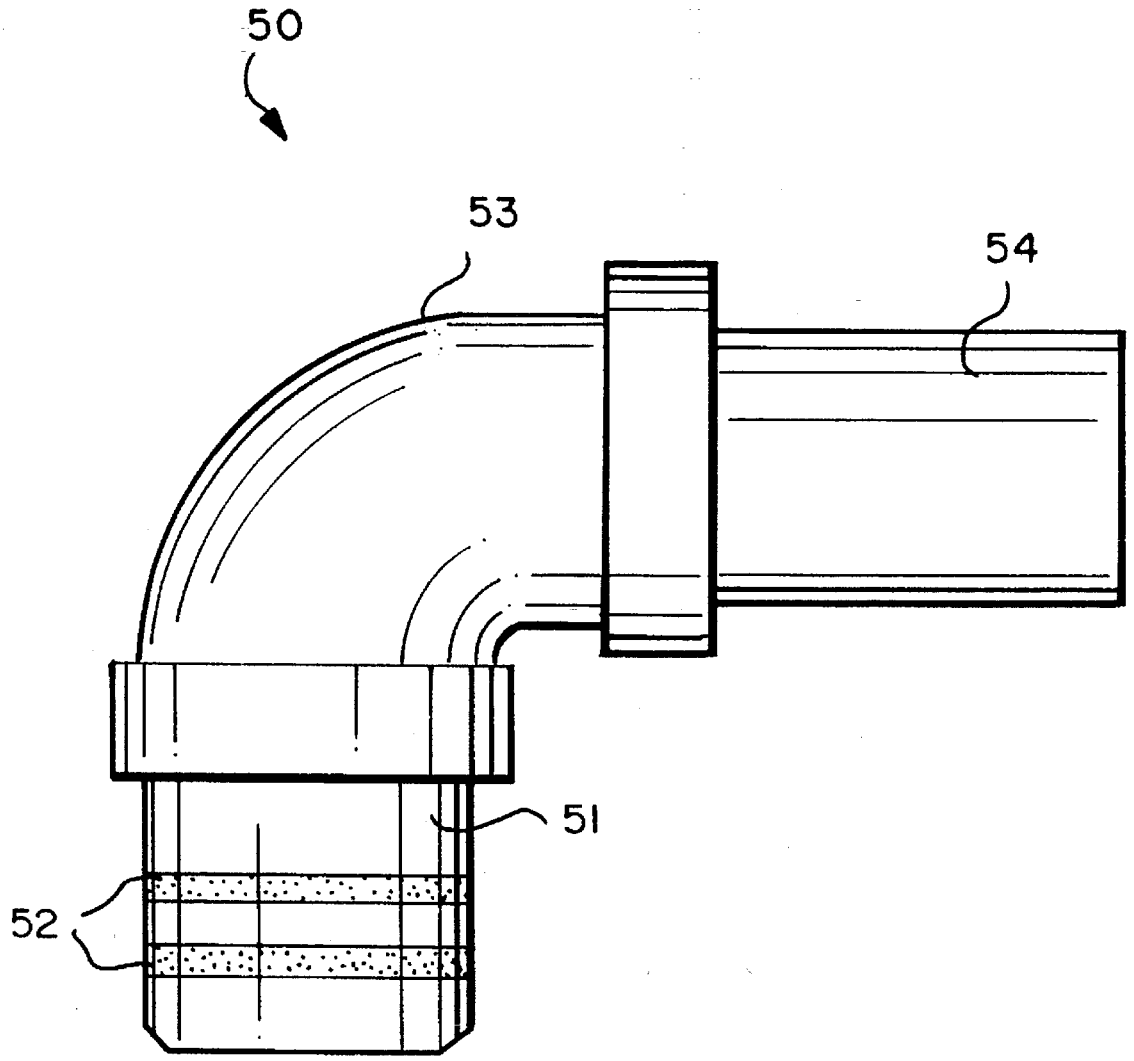
FIG. 8 is a side elevational view of an exemplary embodiment of an elbow fitting used at the inlet opening of the vacuum tank as seen in solid line in FIGS. 1 and 2 and in dotted line in FIG. 4.

In order to provide maximum versatility of mounting of the tank 13, a substantially 90° elbow fitting 50 (see FIGS. 2 and 8) is preferably associated with the tank inlet 18, sealingly and rotatably mounted in the vacuum tank inlet 18 and connected to the first hose 17. As seen in FIG. 8 the fitting 50 includes a first substantially vertically extending tubular end 51 thereof having a double O-ring configuration, as seen by the O-rings 52, with the elbow 53 having a substantially 90° bend and connected to a second tubular section 54 which is inserted inside the hose 17. The tubular end 51 mounting in the inlet 18 allows rotatable movement of the fitting 50 with respect to the tank 13 through an arc of at least about 180°; compare the orientation of the end 54 in FIG. 2 to the orientation shown in dotted line at 54 in FIG. 4. Typically only the pump 14 would stop the rotation of the fitting through 360°.

As seen in FIGS. 3 and 6 in particular, the tank 13 also may include curved recesses 60 therein, which may be provided to break up flat surface areas so that they are not more than about 80 square inches (as described above), as well as a recess 61 formed in the upstanding portion 31 of the tank 13 (see FIG. 3). The recess 61 not only functions to break up flat surface areas so that they are not greater than about 80 square inches, but also—because it is in alignment with the tank inlet 18—allows the hose 17 to pass therethrough so that it may be directly connected to the fitting 50 in the opening 18 (the hose 17 being shown in dotted line in FIG. 3).

The tank 13 also includes a molded cover 63 (see FIG. 2) which covers the motor 64 (see FIG. 7) for the pump 14. The cover 63 is removable. Another opening 65 (see FIGS. 3, 4, and 6), is also provided in the tank portion 31. A conventional vacuum switch 66 (for controlling moor 64) extends into, and plugs, the opening 65. The vacuum switch 66 may also have a double-O-ring fitting [similar to those for the plug 42 and the tubular end 51 seen in FIGS. 7 and 8]. This creates a vacuum type seal while allowing for easy installation or removal. The vacuum switch 66 typically controls the pump moor 64 so that the pump 14 shuts off when the vacuum within the tank 13 (as sensed through the opening 65) is at about ten inches of mercury, and the pump 14 turns back on if the vacuum falls below about eight inches of mercury.

It will thus be seen that according to the present invention an advantageous vacuum toilet assembly and vacuum tank construction have been provided. While the invention has been herein shown and described in what is presently conceived to be the most practical and preferred embodiment thereof it will be apparent to those of ordinary skill in the art that many modifications may be made thereof within the scope of the invention which scope is to be accorded the broadest interpretation of the appended claims so as to encompass all equivalent structures and devices.

What is claimed is:

1. A vacuum toilet assembly comprising:

a vacuum toilet having a waste discharge normally closed by a vacuum-tight valve;

a vacuum tank having a first top surface, a bottom, a length, a width, an inlet, and an outlet, said top surface vertically above said bottom;

a waste tank having an inlet and an outlet;

a vacuum pump having an inlet and an outlet;

a first hose connecting said waste discharge of said toilet, adjacent said vacuum-tight valve, to said vacuum tank inlet;

a second hose connecting said vacuum pump outlet to said waste tank inlet;

said vacuum tank outlet directly connected to said vacuum pump inlet; and said vacuum pump mounted on said first top surface of said vacuum tank.

2. A vacuum toilet assembly as recited in claim 1 wherein said vacuum tank further includes a substantially vertically extending end portion, extending upwardly from said first top surface and having a second top surface and an inner side wall facing said vacuum tank inlet; and wherein said vacuum tank outlet is in said inner side wall.

3. A vacuum toilet assembly as recited in claim 1 wherein said vacuum tank inlet is on the opposite side of said vacuum tank from said vacuum tank outlet along the length of said vacuum tank.

4. A vacuum toilet assembly as recited in claim 3 wherein said vacuum tank inlet is on the opposite side of said vacuum tank from said vacuum tank outlet along the width of said vacuum tank.

5. A vacuum toilet assembly as recited in claim 3 wherein said pump is mounted on said vacuum tank between said vacuum tank inlet and outlet along the length of said vacuum tank.

6. A vacuum toilet assembly as recited in claim 5 wherein said vacuum tank further includes a substantially vertically extending end portion, extending upwardly from said first top surface and having a second top surface and an inner side wall facing said vacuum tank inlet; and wherein said vacuum tank outlet is in said inner side wall.

7. A vacuum toilet assembly as recited in claim 6 wherein said vacuum tank inlet is in said first top surface.

8. A vacuum toilet assembly as recited in claim 7 further comprising a substantially ninety degree elbow fitting sealingly rotatably mounted in said vacuum tank inlet, and connected to said first hose.

9. A vacuum toilet assembly as recited in claim 8 wherein said elbow fitting comprises a mounting portion having a double O-ring seal which extends substantially vertically and about which said elbow fitting is sealingly rotatable through an arc of at least about 180 degrees.

10. A vacuum toilet assembly as recited in claim 6 further comprising a vacuum switch connected to said inner sidewall and sensing vacuum within said vacuum tank substantially vertically extending portion.

11. A vacuum toilet assembly as recited in claim 6 further comprising a dip tube assembly including a substantially rigid dip tube which extends from said vacuum tank outlet to just above said vacuum tank bottom.

12. A vacuum toilet assembly as recited in claim 11 wherein said dip tube comprises a substantially circular cross-section pipe having a portion elongated along an axis of elongation, and having an open end termination remote from said vacuum tank outlet, said end termination cut at an angle to said axis of elongation so as to define a substantially oval-shaped opening which is above, but spaced from, said vacuum tank bottom, and makes an angle of about 20°–40° with respect thereto.

13. A vacuum toilet assembly as recited in claim 12 further comprising a spin nut connection between said dip tube assembly and said vacuum pump inlet.

14. A vacuum toilet assembly as recited in claim 12 wherein said dip tube assembly further comprises a double O-ring plug, said plug sealingly and readily removably connecting said dip tube assembly to said vacuum tank outlet; and wherein said dip tube has a substantially J-shaped configuration.

15. A vacuum toilet assembly as recited in claim 12 wherein said vacuum tank bottom comprises a sump located in substantially the middle of said vacuum tank width, and approximately below said inner side wall, remote from said vacuum tank inlet, said end termination opening of said dip tube disposed above said sump and positioned with respect to said sump so that objects of a size that would harm said vacuum pump cannot pass between said vacuum tank bottom and said open end termination into said substantially oval-shaped opening, but liquid and waste may readily pass therethrough.

16. A vacuum toilet assembly as recited in claim 15 wherein said vacuum tank further comprises four feet extending downwardly from said bottom of said vacuum tank, and supporting said sump off a flat substantially horizontal support surface.

17. A vacuum toilet assembly comprising:

a vacuum toilet having a waste discharge normally closed by a vacuum-tight valve;

a vacuum tank having a first top surface, a bottom, a length, a width, an inlet, and an outlet;

a waste tank having an inlet and an outlet;

a vacuum pump having an inlet and an outlet;

a first hose connecting said waste discharge of said toilet, adjacent said vacuum-tight valve, to said vacuum tank inlet;

a second hose connecting said vacuum pump outlet to said waste tank inlet;

said vacuum tank outlet directly connected to said vacuum pump inlet;

said vacuum pump mounted on said first top surface of said vacuum tank;

a dip tube assembly including a substantially rigid dip tube which extends from said vacuum tank outlet to just above said vacuum tank bottom, said dip tube comprising: a substantially circular cross-section pipe having a portion elongated along an axis of elongation, and having an open end termination remote from said vacuum tank outlet, aid end termination cut at an angle to said axis of elongation so as to define a substantially oval-shaped opening which is above, but spaced from, said vacuum tank bottom, and makes an angle of about 20°–40° with respect thereto; and wherein said dip tube assembly further comprises a double O-ring plug, said plug sealingly and readily removably connecting said dip tube assembly to said vacuum tank outlet; and wherein said dip tube has a substantially J-shaped configuration.

18. A vacuum toilet assembly as recited in claim 17 wherein said vacuum tank bottom comprises a sump located in substantially the middle of said vacuum tank width, and approximately below said inner side wall, remote from said vacuum tank inlet, said end termination opening of said dip tube disposed above said sump and positioned with respect to said sump so that objects of a size that would harm said vacuum pump cannot pass between said vacuum tank bottom and said open end termination into said substantially oval-shaped opening, but liquid and waste may readily pass therethrough.

19. A vacuum toilet assembly as recited in claim 17 further comprising a spin nut connection between said dip tube assembly and said vacuum pump inlet.

20. A vacuum toilet assembly comprising:

a vacuum toilet having a waste discharge normally closed by a vacuum-tight valve;

a vacuum tank having a first top surface, a bottom, a length, a width, an inlet, and an outlet;

a waste tank having an inlet and an outlet;

a vacuum pump having an inlet and an outlet;

a first hose connecting said waste discharge of said toilet, adjacent said vacuum-tight valve, to said vacuum tank inlet;

a second hose connecting said vacuum pump outlet to said waste tank inlet;

said vacuum tank outlet directly connected to said vacuum pump inlet;

said vacuum pump mounted on said first top surface of said vacuum tank; and wherein said vacuum tank inlet is in said first top surface, and further comprising a substantially 90° elbow fitting sealingly rotatably mounted in said vacuum tank inlet, and connected to said first hose.

21. A vacuum toilet assembly as recited in claim 20 wherein said elbow fitting comprises a mounting portion having a double O-ring seal which extends substantially vertically and about which said elbow fitting is sealingly rotatable through an arc of at least about 180°.

* * * * *